United States Patent [19]

Berghahn

[11] 4,406,376

[45] Sep. 27, 1983

[54] REVERSIBLE CHILD RESISTANT CLOSURE

[75] Inventor: Walter G. Berghahn, Scotch Plains, N.J.

[73] Assignee: Bristol-Myers Company, New York, N.Y.

[21] Appl. No.: 367,699

[22] Filed: Apr. 12, 1982

[51] Int. Cl.[3] ..... B65D 55/02

[52] U.S. Cl. ..... 215/224; 215/211

[58] Field of Search ..... 215/205, 206, 211, 224, 215/225

[56] References Cited

U.S. PATENT DOCUMENTS

| | | | |
|---|---|---|---|
| 3,757,979 | 9/1973 | Berghahn | 215/224 |
| 3,863,797 | 2/1975 | Berghahn | 215/225 |
| 3,865,267 | 2/1975 | Morris | 215/206 |
| 3,926,325 | 12/1975 | Benson | 215/224 |
| 4,036,385 | 7/1977 | Morris | 215/216 |
| 4,103,797 | 8/1978 | Morris | 215/211 |
| 4,103,798 | 8/1978 | Moeller | 215/305 |

*Primary Examiner*—George T. Hall

*Attorney, Agent, or Firm*—Irving Holtzman; Gabriel P. Katona; George A. Mentis

[57] ABSTRACT

A reversible child resistant closure having a child resistant and a non-child resistant mode of use. The closure is characterized by its low profile and tab that extends outwardly from the closure; this tab being engageable from below when closure is rotated into the appropriate position on the container. An upwardly extending relatively low annular rib is provided on the roof of the closure which serves as the means by which the closure is engaged by the container neck when the closure is inserted into the container neck in its non-child resistant mode.

6 Claims, 6 Drawing Figures

FIG. 1
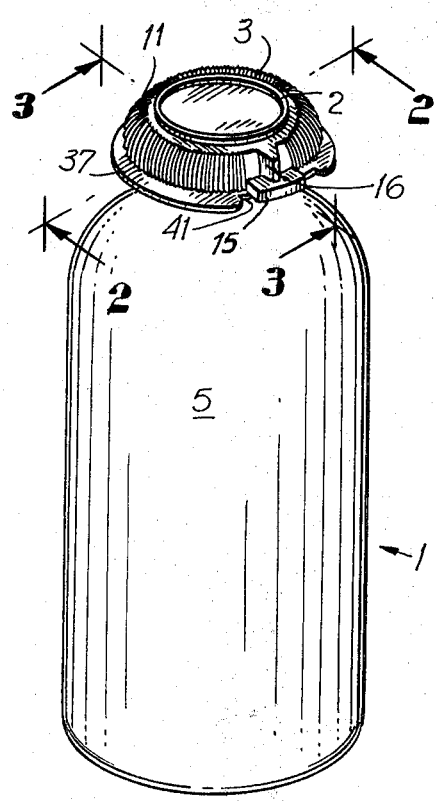
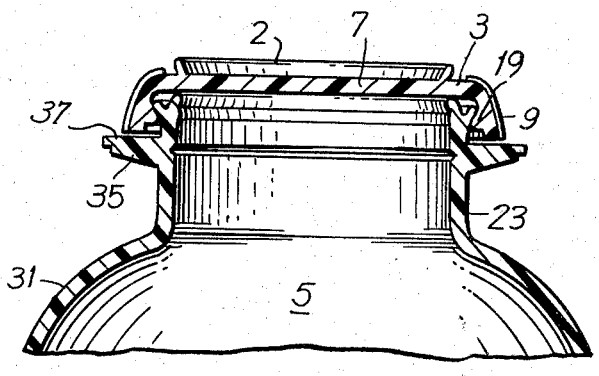
FIG. 2
FIG. 3
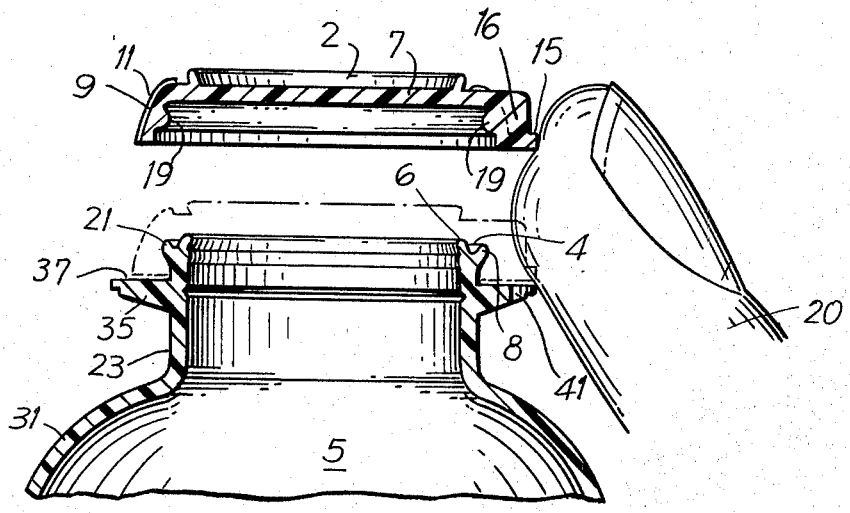

FIG. 4
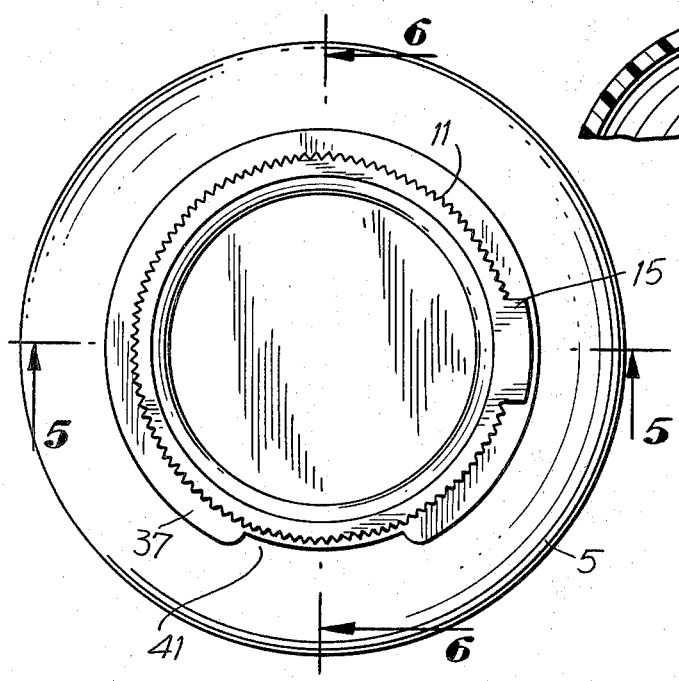
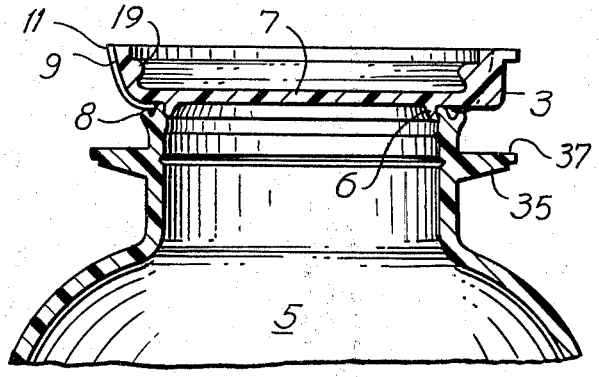
FIG. 5
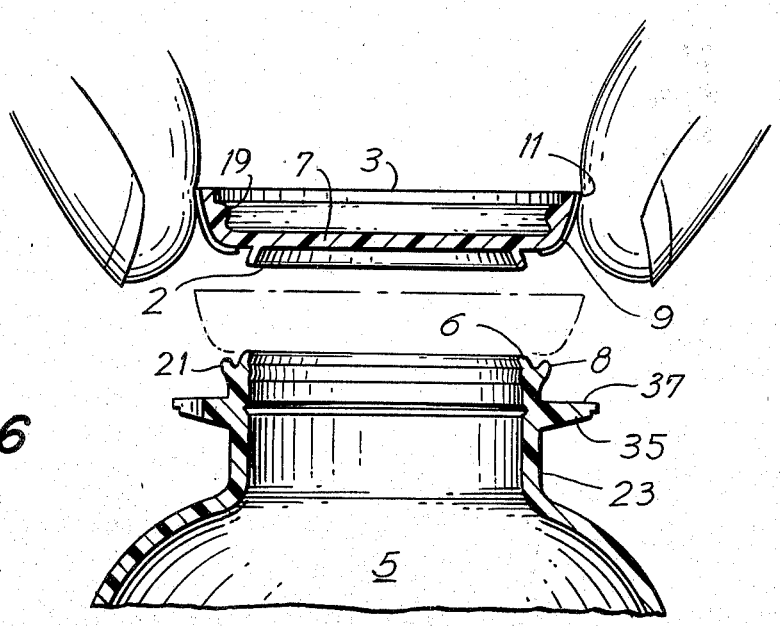
FIG. 6

REVERSIBLE CHILD RESISTANT CLOSURE

BACKGROUND OF INVENTION

This invention relates to a reversible child resistant closure. More particularly, it concerns a closure which when applied to a bottle or other container in a first or child resistant position provides an obstacle to a child in removing the closure from the container; whereas, in its second or non-child resistant position, it may be readily removed by an adult.

The danger of small children getting into a medicine cabinet and removing dangerous pills from bottles or other containers is a well known problem. Many suggestions have been made in the prior art for dealing with this; one such suggestion being described in the U.S. patent to Walter G. Berghahn, U.S. Pat. No. 3,757,979 and its companion, U.S. Pat. No. 3,863,797.

Although child resistant closures of the type described in the Berghahn patent are effective as child resistant closures, they present somewhat of a problem for some adults when it comes to removing them from their containers. This problem is compounded by the fact that the individuals who need to get access to the contents of these containers often are afflicted with certain disabilities that make it difficult for them to manipulate these child resistant closures for removal. Perhaps the most common example of this is the case of people suffering from arthritis that involves the hands and fingers. Such people often require daily medication such as aspirin containing products and it is important that they be able to readily manipulate the closure for removal.

SUMMARY OF INVENTION

The present invention provides a solution to this problem by structuring the container closure so that it is a reversible child resistant closure. In the first position, or child resistant position, the closure of the present invention when applied to a container is adapted to function as a child resistant closure which nevertheless can be removed with some facility by normal adults. In the second or inverted position, the closure is constructed so as to be readily removable by adults who even have restricted use of their hands or fingers. The closure is designed so as to have an ungainly appearance when mounted on the container in the non-child resistant mode to insure that the user is aware of this and that he did not erroneously mount it in this mode.

PRIOR ART

A few suggestions appear in the prior art for closures which are ostensibly reversible child resistant closures. These include the U.S. patents to Glenn H. Morris, U.S. Pat. Nos. 3,865,267 and 4,103,797 as well as the U.S. patent to Louis Benson, U.S. Pat. No. 3,926,325. However, these patents describe devices which, although labelled as child resistant devices, are of questionable utility in this regard or are so complicated as to make the removal of these devices in the child resistant mode even too difficult for adults to manipulate.

The present invention, on the other hand, provides a simple and effective device which very adequately serves as a child resistant closure but yet may be readily removed by an adult in the child resistant mode. In addition, in the non-child resistant mode, the closure may be removed easily even by persons whose ability to use their hands is severely limited.

BRIEF DESCRIPTION OF DRAWINGS

FIG. 1 is a perspective view of the closure and a container embodied in the present invention; the closure being shown applied to the container in its child resistant mode;

FIG. 2 is a partial cross sectional view taken along line 2—2 of FIG. 1;

FIG. 3 is a partial cross sectional view taken along line 3—3 of FIG. 1; the closure being shown as being removed;

FIG. 4 is a top plan view of the closure and container embodied in the present invention; the closure being shown mounted on the container in its non-child resistant mode;

FIG. 5 is a partial cross sectional view taken along line 5—5 of FIG. 4; and FIG. 6 is a partial sectional view taken along line 6—6 of FIG. 4 showing the manner in which closure may be removed from the container when mounted in the non-child resistant mode.

DESCRIPTION OF THE INVENTION

Referring now to the drawings of the present case in which like numbers represent the same structure in the various views, the safety closure bottle assembly is shown generally at 1 in FIG. 1 and comprises a flexible safety closure 3 and a bottle 5. Safety closure 3 includes a roof 7 and a tapered skirt 9 extending downwadly from roof 7. In the modification of this invention shown in FIG. 1 skirt 9 is provided with a plurality of serrations 11 which serve as a gripping surface to assist in the rotation of safety closure 3.

Adjacent to the lower margin of skirt 9 and extending outwardly therefrom there is provided a tab 15. This is used to remove the closure from the bottle when the closure is mounted on the bottle in the child resistant mode and rotated into position for removal.

Safety closure 3 is also constructed with an inwardly extending annular bead 19 best shown in the longitudinal sectional view of FIG. 3. Annular bead 19 is spaced from the lower margin of skirt 9 and is located on the internal surface of skirt 9 so as to engage protuberance 21 on neck 23 of bottle 5 in a fashion described in more detail below.

The safety closure 3 as best shown in FIG. 3 is a low profile closure and is provided with a single tab 15. To facilitate the turning of the closure, there is further made available lug 16 which protrudes outwardly slightly from the relatively low skirt 9. Lug 16 can be engaged by the nails so that the closure may be rotated for opening or closing. The shortness of skirt 9 in this modification (about one tenth the outer diameter of the major portion of closure 3) and the downward and outward taper of skirt 9 as is apparent from FIG. 3 makes it difficult for a child to get its teeth on it.

The bottle 5 of the present assembly comprises a neck portion 23 previously mentioned and a body portion 31. Slightly above the base of neck portion 23 there is provided an annular flange 35 extending outwardly from said neck portion. Flange 35 has a flat upper surface 37 which extends outwardly well beyond the major portion of the circumference of the safety closure 3 when the latter is seated on bottle 5 as described in more detail below. As best seen in FIG. 3, flange 35 in cross section tapers upwardly and outwardly and thus has its thickest portion at a point adjacent the neck of the bottle. This thickness provides bulk and strength to flange 35 so as to prevent its ready fracture.

Flange 35 is also provided with a notch 41 dimensioned so as to be at least as long as tab 15 along its circumference. Notch 41 permits ready access to tab 15 from below when the latter is positioned so as to lie over notch 41. In this position tab 15 may be engaged by the thumb and the safety closure 3 forced upwardly and removed. This is best illustrated in FIG. 3. The position of the closure 3 rotated into a position so that tab 15 overlies notch 41 is seen in dotted line in FIG. 3. Closure 3 in full line is shown being lifted upwardly by thumb 20 which engages tab 15 and pushes it upwardly.

Neck 23 of bottle 5 as previously noted is provided with an outwardly extending protuberance 21. This is best seen in FIG. 3. In applying safety closure 3 onto bottle 5 it is necessary to flex the safety closure over protuberance 21. When this is accomplished, annular bead 19 of the safety closure comes to rest below protuberance 21 of bottle 5 in a snap fit. This relationship provides a certain amount of resistance which must be overcome in flipping the safety closure 3 upwardly.

An important feature of the present invention is the relationship that exists between the surface of the lower margin of safety closure 3 and flange 35. As previously noted, flange 35 is provided with a flat and extended upper surface 37. This abuts flushly against the surface of the lower margin of safety closure 3 when the latter is in position on the bottle so that the respective abutting surfaces are substantially at right angles to each other. This greatly reduces the possibility of obtaining a purchase on the lower margin of safety closure 3 with the thumb or even the teeth by getting them in between the said lower margin and said flat upper surface 37 of flange 35.

Extending upwardly from the top of roof 7 of closure 3 there is provided an annular ridge 2. Annular ridge 2 is integral with the roof of closure 3 and is molded from the same material used to mold closure 3. Annular ridge 2 is designed so that when the closure 3 is reversed for insertion in bottle 3 in the non-child resistant mode, ridge 2 slants downwardly and outwardly. This is best seen with reference to 6. Furthermore, ridge 2 is also constructed so that it has enough flexibility to be compressed inwardly and to provide a snap fit when closure 3 is inserted into neck 23. The cross sectional thickness of ridge 2 may vary somewhat. Usually, the thickness will be in the range of from about 0.010" to about 0.060". The vertical dimension of ridge 2 may also vary somewhat. It will ordinarily be such that a child cannot grip it with its teeth. A suitable height would be 0.125" and below.

To assure that an adequate snap fit is obtained when closure 3 is inserted into neck 23 in the non-child resistant mode, the groove 4 is cut in the upper margin of neck 23. This forms inner and outer lips 6 and 8 respectively on neck 23. Lip 6 because of its relatively small bulk is made somewhat flexible an will be forced outwardly when ridge 2 engages it during the seating of closure 3 in neck 23 in the non-child resistant mode. The final position of the respective parts of the closure 3 and neck 23 is best seen with respect to FIG. 5.

Both safety closure 3 and bottle 5 of the present invention are each preferably molded as unitary pieces from thermoplastic resins. This has a distinct advantage, particularly with regard to bottle 5 since it makes possible the formation of the relatively extended flange 35 having a flat upper surface 37. It is not possible or practical to mold an equivalent structure in glass. A variety of thermoplastic resins are known in the prior art which are useful for this purpose. Among these mention may be made of high and low density polyethylene, polypropylene, polystyrene and polyvinyl chloride.

In some instances when the safety closure 3 and bottle 5 are made of certain thermoplastic resins, there is a tendency for the closure and bottle to bind so that it may be difficult to turn the safety closure when it is seated on the bottle. To minimize this, in accordance with the present invention, different thermoplastic materials may be used for the safety closure and the bottle. This may take the form of different thermoplastic resins or different grades of the same thermoplastic resin, e.g. high and low density polyethylene.

As an alternative to or in addition to employing different thermoplastic materials for the safety closure and bottle, the binding effect noted above may be minimized by incorporating in one or both of said components a slip additive. In a preferred form of this invention, the slip additive is introduced into the thermoplastic material mix used to mold the safety closure prior to molding the same. In this instance, it will be necessary to select a slip additive which is stable at relatively high temperatures e.g. about 500° F. since temperatures of this order are reached in molding the safety closure.

To be effective for the above purposes, i.e. to prevent binding between the safety closure and the bottle, the slip additive must be present in an amount of at least about 1,000 ppm based on the total weight of the thermoplastic resin molding mix used to mold the safety closure and preferably between 1,000 and 5,000 ppm by weight of said molding mix. In this connection, Applicant would like to call attention to the fact that it has been suggested to incorporate a slip additive in polyethylene before molding this material into a bottle cap. The purpose of this procedure was to lubricate the cap so that it would not get hung up in the assembly machinery. However, the quantities of slip additive used for this purpose are much lower than that needed to prevent the binding between the safety closure and the bottle in accordance with the present invention.

A variety of slip additives well known to those skilled in the art are available for the present purposes. By way of illustration, mention may be made of the following: erucamides (e.g. erucic acid amide); silicones (e.g. dimethylpolysiloxane viscosity 20,000 to 60,000 centistokes); stearates (e.g. magnesium stearate); oleoamides (e.g. hydrogenated tallow amide) etc.

Another feature of the present invention is the application of a substance to the safety closure which imparts to it an unpleasant taste. Often children attempt to remove a closure from a container by prying it off with their teeth. If the closure has an unpleasant taste, the likelihood that a child would keep it in his mouth long enough for him to pry it off would be reduced.

The unpleasant tasting substance may be applied to the present safety closure by impregnation or by coating. Ordinarily, it will be applied from a non-toxic solution containing about 0.001% to 0.002% by weight of the unpleasant tasting material. Ordinarily, this solution will be an aqueous solution, but other non-toxic solvents may also be used to dissolve the unpleasant tasting material. By way of illustration of said solvents, mention may be made of water, ethyl alcohol, aqueous ethyl alcohol, etc.

A variety of unpleasant tasting materials non-toxic in the concentrations employed in this invention are known in the prior art which are suitable for the present purposes. Among these the following may be mentioned: denatonium benzoate (BITREX), quinine, brucine, etc.

A virtue of the present invention is that it provides the user with the option of using this closure described herein in one of two modes. If the household in which a bottle containing a pharmaceutical product or other product that may be hazardous is employed has small children who are liable to be injured by ingesting the contents of the bottle, the user has the option of always employing the closure in its child resistant mode. On the other hand, if there are no children in the household, the user may elect to use the closure in its non-child resistant mode. This avoid the need for providing separate closures for different classes of user. The same closure can be used to the benefit of each type of user.

Another virtue of the present invention is the fact that when the closure is mounted on the container in the non-child resistant mode it has an ungainly appearance. This is best appreciated with respect to FIGS. 4 and 5 in which the closure clearly appears as if it has been inserted into the bottle in an upside down position. This ungainly appearance serves to flag the fact that the closure is mounted in the non-child resistant mode. In the event that the user intended to use the closure in the child resistant mode, but erroneously mounted it in the non-child resistant mode, the unusual appearance of the closure in the latter mode should quickly call his attention to this error.

Although the invention has been described with reference to specific forms thereof, it will be understood that many changes and modifications may be made without departing from the spirit of this invention.

What is claimed is:

1. A reversible child resistant snap-on closure; said closure being adapted to serve as a child resistant closure when applied to a container in a first upright position while being adapted for ready removal by an adult from a container when applied to said container in a second inverted position, said closure being a low profile flexible snap-on closure for a container having a neck, said closure having a roof, a skirt and a lower marginal surface having an internal diameter of substantially uniform size; said skirt being provided on the internal surface thereof with means for engaging a portion of the neck of said container; said snap-on closure being provided with a tab extending outwardly from said lower marginal surface and having a lower surface which is in substantially the same plane as the lower marginal surface of said closure; said skirt being tapered downwardly and outwardly from said closure roof to the outer circumference of said lower marginal surface, the shortness of said skirt and its taper being such as to make it difficult for a child to get its teeth on it when the closure is in position on a bottle in the child resistant position; said closure also being provided with an annular ridge extending upwardly from the top of said closure roof, said annular ridge being slanted downwardly and outwardly when said closure is held in its inverted position, said annular ridge being adapted to be compressed inwardly when applied to a container so that it will engage the inner wall of the neck of said container in a snap-fit relationship.

2. A snap-on closure according to claim 1 wherein the vertical dimension of the closure is about one tenth the outer diameter of the major portion of said closure.

3. A snap-on closure according to claim 1 wherein the closure is molded from high density polyethylene.

4. A snap-on closure according to claim 1 wherein the closure is molded from polypropylene.

5. A reversible child resistant snap-on closure and bottle assembly comprising a flexible snap-on closure having a bottle engaging portion which is substantially circular in cross section; said closure being adapted to serve as a child resistant closure when applied to said bottle in a first upright position while being adapted for ready removal by an adult from said bottle when applied to said bottle in a second inverted position, said closure being a low profile flexible snap-on closure for said bottle having a neck; said closure having a roof, a skirt and a lower marginal surface having an internal diameter of substantially uniform size; said skirt being provided on the internal surface thereof with means for engaging a portion of said neck of said bottle, said snap-on closure being provided with a tab extending outwardly from said lower marginal surface and having a lower surface which is in substantially the same plane as the lower marginal surface of said closure; said skirt being tapered downwardly and outwardly from said closure roof to the outer circumference of said lower marginal surface; the shortness of said skirt and its taper being such as to make it difficult for a child to get its teeth on it when the closure is in position on a bottle in the child resistant position; said closure also being provided with an annular ridge extending upwardly from the top of said closure roof, said annular ridge being slanted downwardly and outwardly when said closure is held in its inverted position; said annular ridge being adapted to be compressed inwardly when applied to said bottle so that it will engage the inner wall of the neck of said bottle in a snap-fit relationship; said bottle being provided with a flange extending outwardly from said bottle in the region adjacent its closure receiving portion; said flange having a horizontally extending flat top surface adapted to flushly engage said lower marginal surface of said snap-on closure and further being provided with a notch; said snap-on closure being capable of being snapped over the open end of said bottle irrespective of the relative circumferential position of said tab with respect to said flange, the relative radial dimensions of the various portions of the assembly and the relative dimensions of said tab and notch being such that said closure is engageable from below for removal substantially only when it is positioned so that said tab is above said notch when the assembly is in its upright position.

6. A snap-on closure and bottle assembly according to claim 5 in which said closure is molded of polypropylene.

* * * * *